US010309599B2

(12) United States Patent
Angelotti

(10) Patent No.: US 10,309,599 B2
(45) Date of Patent: Jun. 4, 2019

(54) MODULATED RESONATOR GENERATING A SIMULATED FLAME

(71) Applicant: Philip Angelotti, Chandler, AZ (US)

(72) Inventor: Philip Angelotti, Chandler, AZ (US)

( * ) Notice: Subject to any disclaimer, the term of this patent is extended or adjusted under 35 U.S.C. 154(b) by 0 days.

(21) Appl. No.: 16/122,748

(22) Filed: Sep. 5, 2018

(65) Prior Publication Data

US 2019/0003670 A1 Jan. 3, 2019

Related U.S. Application Data

(63) Continuation-in-part of application No. PCT/US2017/036862, filed on Jun. 9, 2017, which is a continuation of application No. 15/179,706, filed on Jun. 10, 2016, now Pat. No. 9,568,157.

(60) Provisional application No. 62/173,809, filed on Jun. 10, 2015, provisional application No. 62/555,051, filed on Sep. 7, 2017, provisional application No. 62/554,419, filed on Sep. 5, 2017.

(51) Int. Cl.

| | |
|---|---|
| ***B01F 3/04*** | (2006.01) |
| ***F21S 10/04*** | (2006.01) |
| ***B05B 17/06*** | (2006.01) |
| ***B05B 17/00*** | (2006.01) |
| *F21S 10/00* | (2006.01) |

(52) U.S. Cl.

CPC ..... *F21S 10/04* (2013.01); *B01F 3/0407* (2013.01); *B05B 17/0607* (2013.01); *B05B 17/0615* (2013.01); *B05B 17/0646* (2013.01); *B05B 17/0684* (2013.01); *B05B 17/0676* (2013.01); *F21S 10/002* (2013.01)

(58) Field of Classification Search

CPC ..... A61L 9/122; B01F 3/04; B01F 3/04007; B01F 3/04021; B01F 3/0407

USPC ..... 261/26, 30, 81, 107; 362/96

See application file for complete search history.

(56) References Cited

U.S. PATENT DOCUMENTS

| | | | | |
|---|---|---|---|---|
| 7,029,146 | B2 | 4/2006 | Kitchen | |
| 7,159,994 | B2 | 1/2007 | Schnuckle et al. | |
| 7,992,801 | B2 | 8/2011 | Jörgensen | |
| 8,783,888 | B2 * | 7/2014 | McCavit | A61L 9/122 362/96 |
| 9,756,707 | B2 | 9/2017 | Patton et al. | |
| 2014/0312136 | A1 * | 10/2014 | Kubicek | B05B 7/02 239/8 |

* cited by examiner

*Primary Examiner* — Robert A Hopkins

(74) *Attorney, Agent, or Firm* — Inspired Idea Solutions Law Firm; Wayne Carroll

(57) ABSTRACT

An artificial flame apparatus produces a simulated flame using a plume of mist that is illuminated around, about, and through an artificial wick. A mist may be produced by a transducer, such as an ultrasonic transducer that is in contact with liquid from a liquid reservoir. The rate of mist exiting the housing may be modulated to produce a more realistic looking artificial flame. A light source is configured to illuminate the mist and/or the artificial wick. The artificial wick may be in the shape of a wick or flame and may include a light source. One or more light sources may be configured as the artificial wick. The light intensity, color and rate of change of light may be modulated to produce a more realistic looking artificial flame. A standing wave tube may vary the rate of mist exiting one or more enclosure openings in the tube enclosure.

23 Claims, 11 Drawing Sheets

MODULATED RESONATOR GENERATING A SIMULATED FLAME

CROSS REFERENCE TO RELATED APPLICATIONS

This application is a continuation in part of PCT patent application no. PCT/US2017/036862, having an international filing date of Jun. 9, 2017 and claiming the benefit of U.S. patent application Ser. No. 15/179,706, filed on Jun. 10, 2016 and now issued as U.S. Pat. No. 9,568,157 on Feb. 14, 2017; and this application claims the benefit of priority to U.S. provisional patent application No. 62/555,051 filed on Sep. 7, 2017 and to U.S. provisional patent application No. 62/554,419, filed on Sep. 5, 2017; the entirety of all applications are hereby incorporated by reference herein.

BACKGROUND

Field of the Invention

This disclosure is generally directed to the creation of an imitation flame for use in non-flammable candles as well as numerous other applications.

Background

Simulated flames in candles are desirable for use in enclosed spaces where a real flame is undesirable, impractical or not permitted. There are different ways to generate simulated flames, and some simulated flames are more realistic than others. Creating a cost effective and compact simulated flame is desirable for many applications in both homes and commercial environments.

SUMMARY

Some embodiments of the disclosure are directed to an apparatus having a transducer configured to transduce and modulate a liquid to form a simulated flame. The transducer may be a piezoelectric transducer driven by a modulated drive signal such that a liquid transduces to a mist/aerosol, such that the transducer controls (or varies) and shapes the mist to create a vapor plume. Use of a nozzle/manifold a certain distance above the transducer may shape the mist as well. The plume is illuminated by a colored light source to generate the simulated flame. A wick or a dispenser may be one means of presenting the liquid to the transducer. Controlling the droplet size presented to the transducer may shape the size, dimension of the plume. The transducer may have multiple transducer openings, angled or straight perforations, notches, and/or impressions to shape the plume and create the effect of a dancing flame.

An exemplary artificial flame apparatus utilizes a mist plume that is illuminated by a light source to imitate a flame. In an exemplary embodiment, the mist exits a housing around an artificial wick. The artificial wick may be shaped like a conventional wick or have a flame shape, such as a silhouette of a flame. The artificial wick may comprise a light source such as a light emitting diode, fiber optics or light tubes, for example. An exemplary artificial wick comprises a plurality of individual light sources or elements, such as LEDs, fiber optics or light tubes that are configured to imitate a wick of a candle and/or a flame. A plurality of fiber optics or light tubes may be spiraled about each other for example and an individual light source may emit a different color light from one of the other light sources. In addition, the light intensity or color may change to produce a more realistic artificial flame appearance. A light source may also be configured in proximity to the mist plume, such as around the base of the mist outlet and may project light onto the exiting mist and/or onto the artificial wick. The light emitted by the light source may be a colored light and may change color and/or intensity to produce a more realistic artificial flame.

The mist of an exemplary artificial flame apparatus is produced by a transducer, such as an ultrasonic transducer having a transducer surface that produces vibrations, such as ultrasonic vibrations that create a mist when in contact with liquid. An exemplary transducer may be a piezoelectric transducer. The liquid from a liquid reservoir within the housing may be in contact with the transducer surface directly, via a porous wick or via droplets that impinge on the transducer surface. A portion of the transducer, such as the transducer surface may be in direct contact with the liquid within the liquid reservoir, whereby the transducer surface may be submerged in the liquid. A wick, such as a porous wick, may transport liquid from the liquid reservoir to the transducer surface through capillary forces. A pump or gravity feed apparatus may present liquid from the liquid reservoir to the transducer surface and may produce droplets that fall onto the transducer surface, which may more effectively control the variation in the production of mist.

The rate of mist exiting the housing may be varied to change the size, shape or height of the mist plume to produce a more realistic looking artificial flame. An oscillator device may be utilized to change the rate of flow of the mist from the housing. An exemplary oscillator comprises an air-moving device, such as a fan, that forces the mist from the housing or mist reservoir. The air-moving device may change the airflow rate, or a valve may be configured to modulate that rate of airflow and thereby change the flow rate of mist exiting the housing. An air-moving device may produce a flow of air that travels through an airflow conduit and then through inlet ports into the mist reservoir. An exemplary oscillator device is a sonic device that produces sound waves and associated sound or acoustic pressure that pushes the mist from the housing. A sonic device or a sound-wave generator may generate sound waves with a sound wave frequency or varying sound wave frequencies. The sound-wave generator may be configured with a standing wave tube having one or more enclosure openings, whereby the rate of mist exiting the one or more enclosure openings may be expelled through the enclosure openings as a function of the standing wave frequency and/or magnitude. An exemplary enclosure, such as a tube, standing wave tube, or Ruben's tube, may be configured proximal to the artificial wick and may have a plurality of enclosure openings to produce a plurality of individual mist plumes. In an exemplary embodiment, a standing wave tube is configured around a portion of the artificial wick and may comprise a toroid shaped enclosure that extends around the artificial wick proximal to the mist outlet. The toroid shaped enclosure may have a plurality of enclosure openings around the outer perimeter of the artificial wick. The sound-wave generator of a standing wave tube may produce sound waves having a beat or rhythm or may produce random sound waves. A standing wave tube may be utilized in an artificial flame apparatus having a plurality of individual artificial wicks and flames, such as an artificial fire table or pit, log or fireplace configuration, and the standing wave may have a rhythm or beat, whereby the rate of flow of mist from the series of enclosure openings changes as a function of the standing wave, sound waves, and/or resultant associated sound or acoustic pressure.

A controller may control and vary the functions of the artificial flame apparatus including the power, frequency, waveform and/or rate of mist exiting the housing through one or more housing openings, and may control the transducer, the rate of liquid delivery to the transducer, the color or intensity of the light, the oscillator and the like. A controller may comprise a microprocessor and/or a control circuit. In an exemplary embodiment, a modulator produces a modulation signal that is used to change one or more of the features of the artificial flame apparatus, such as the intensity, color, rate of change of intensity and/or color of the light, and/or the rate of flow of mist from the housing. A modulator may control the transducer to produce mist and to control a variation of the rate of mist produced. A microprocessor may be configured to run a control program that includes a modulation program, thereby making the microprocessor a modulator.

Liquid within the liquid reservoir may comprise water and other agents such as aromatic agents to produce a mist having a scent. An aroma agent, such as a liquid or solid may be mixed directly with the liquid, such as water, in the liquid reservoir or may be placed in a pod whereby the aroma agent is slowly added to the liquid.

An exemplary artificial flame apparatus may be a single flame having a single artificial wick or may comprise a plurality of artificial wicks and flames. An artificial flame apparatus may be in the shape of a log or be configured in a fire table, fire pit or be an insert to a fire feature or fireplace.

The summary is provided as a general introduction to some of the disclosed embodiments, and is not intended to be limiting. Additional example embodiments including variations and alternative configurations of the disclosed embodiments are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
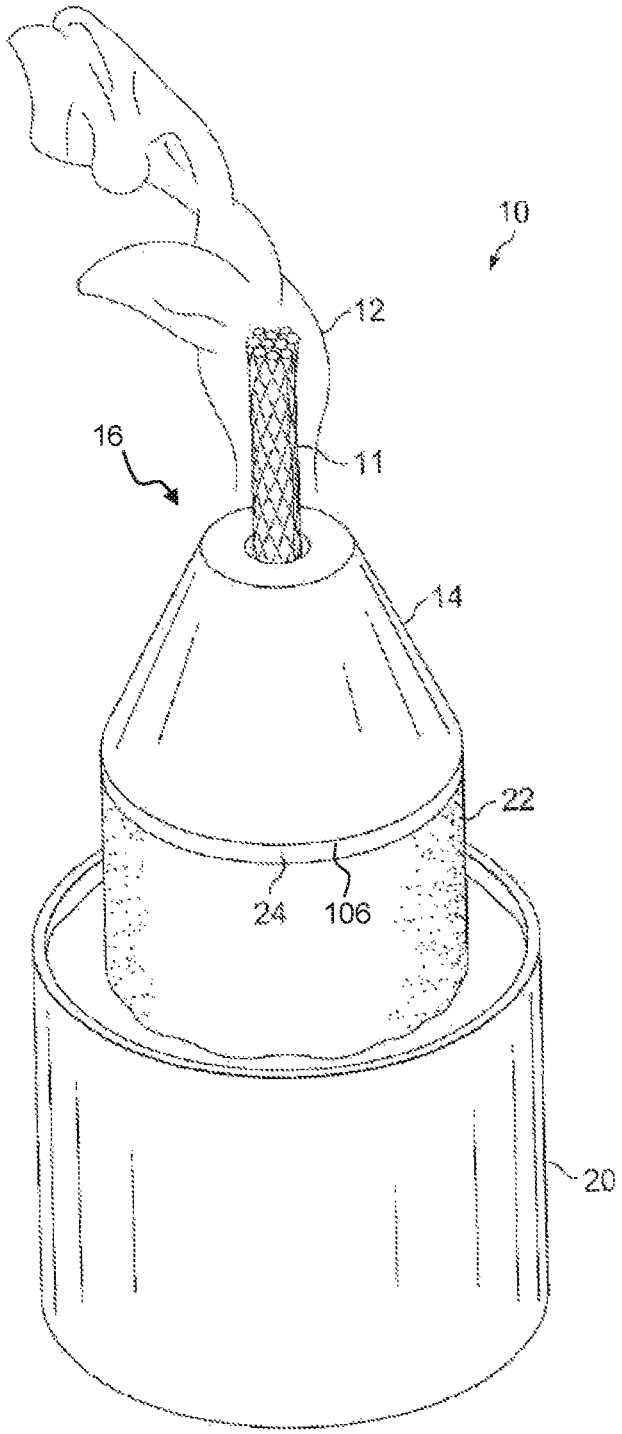
FIG. 1 illustrates a perspective view of an embodiment of this disclosure.

Corresponding reference characters indicate corresponding parts throughout the several views of the Figures. The Figures represent an illustration of some of the embodiments of the present invention and are not to be construed as limiting the scope of the invention in any manner. Further, the Figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying Figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

The following description of exemplary embodiments provides information that enables a person skilled in the art to make and use the subject matter set forth in the appended claims, but may omit certain details already well-known in the art. The following detailed description is, therefore, to be taken as illustrative and not limiting.

The example embodiments may also be described herein with reference to spatial relationships between various elements or to the spatial orientation of various elements depicted in the attached drawings. In general, such relationships or orientation assume a frame of reference. However, as should be recognized by those skilled in the art, this frame of reference is merely a descriptive expedient rather than a strict prescription.

Figure 2:
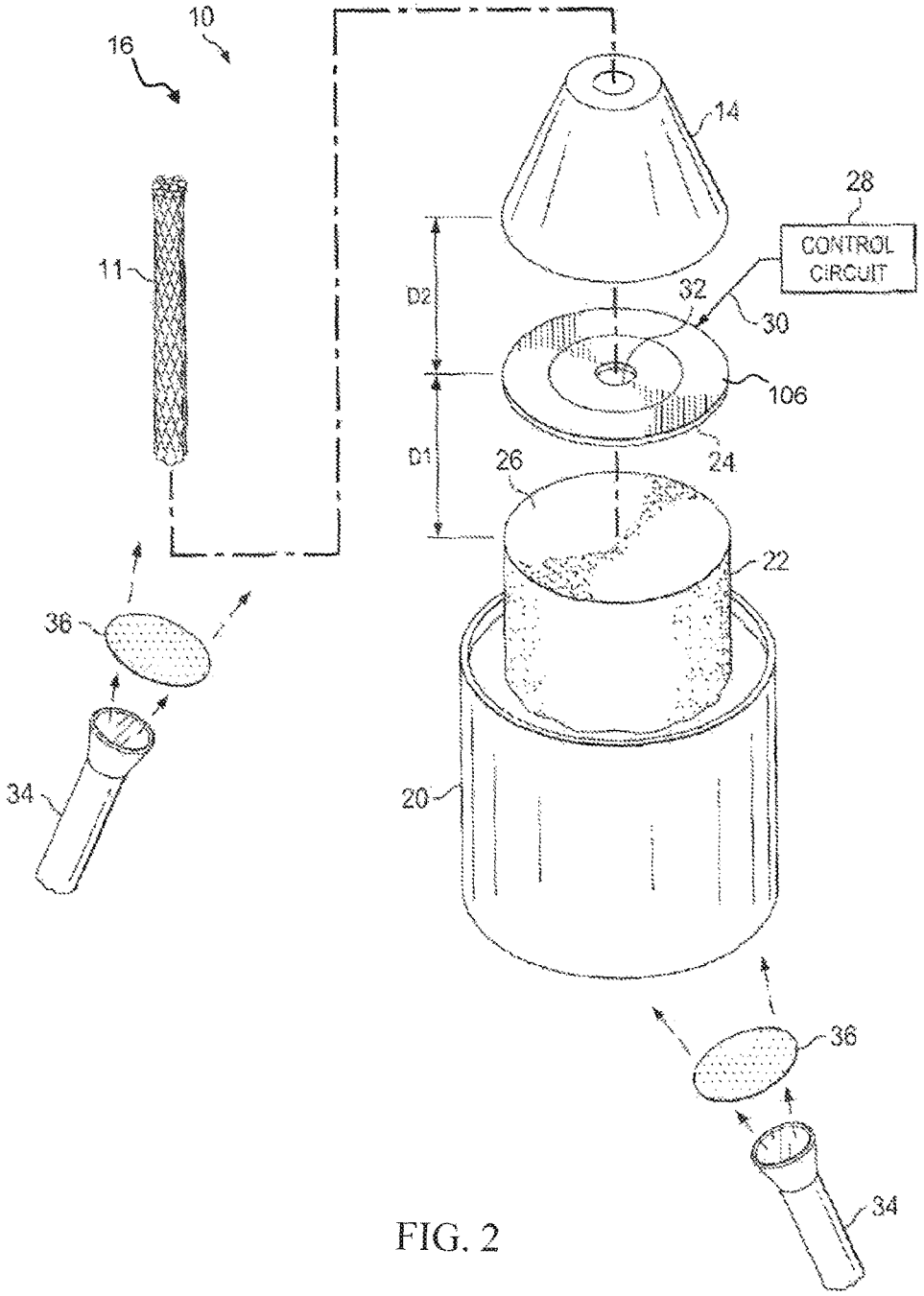
FIG. 2 illustrates an exploded perspective view of the embodiment shown in FIG. 1.

Referring to FIGS. 1 and 2, an exemplary artificial flame apparatus 16 comprises a lead zirconate titanate (PZT) nebulizer forming a candle shown at 10. The candle 10 is configured to generate a simulated candle flame by controllably and irregularly modulating liquid droplets at a varying power and/or frequency to create an aerosol or mist 12 about an artificial wick 11, and then illuminating the vapor mist 12 to produce a flame-like effect. A nozzle 14 is utilized to produce a variety of effects. The liquid may be water, ethanol, essential oils, or any combination of liquids.

Referring to FIG. 2, there is shown an exploded perspective view of the candle 10. Candle 10 comprises a reservoir 20 configured to hold a liquid, such as water. A porous wick structure 22 is concentrically positioned in the reservoir 20 and is configured to wick the liquid from the reservoir 20 and present the liquid to a transducer 106, an ultrasonic resonator 24 as shown. The resonator 24 comprises a PZT piezoelectric ceramic ring resonator and steel membrane assembly that is positioned a distance DI above a top surface 26 of the wick structure 22, and is the active resonant component transducing the liquid into aerosol 12 by means of ultrasonic vibration.

Figure 6:
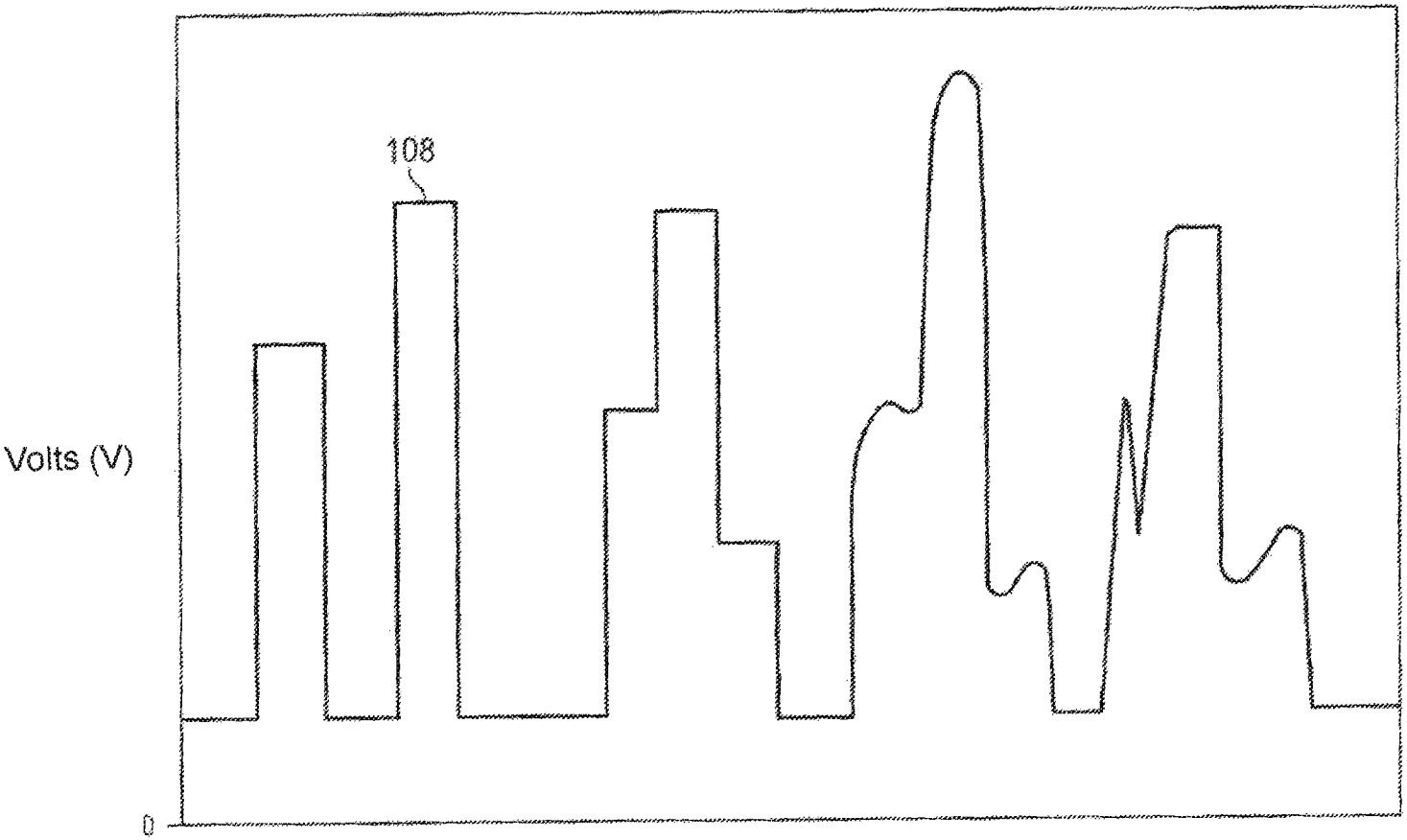
FIG. 6 illustrates a representative waveform diagram(s) depicting a drive signal from the control circuit to modulate the resonator.

The resonator 24 is controlled by a control circuit 28 that provides a selectively controllable electrical modulated drive signal 30 to control variations in the shape and appearance of the generated aerosol 12. The drive signal 30 may be pulsed, and generated at varying power levels, frequencies and waveshapes to variably control the transducing energy and produce a dancing flame-like effect, and such that it swirls, floats, or produces other selected shapes, such as shown in FIG. 6.

The mist directing/shaping nozzle 14, shown as a cone, is configured to shape the aerosol vapor 12. The nozzle 14 may be positioned directly on the top surface of the wick structure 22 and above the resonator 24, but is preferably spaced a distance D2 above the resonator 24, and a distance DI+D2 above the wick structure 22 such as using spacers.

Figure 15:
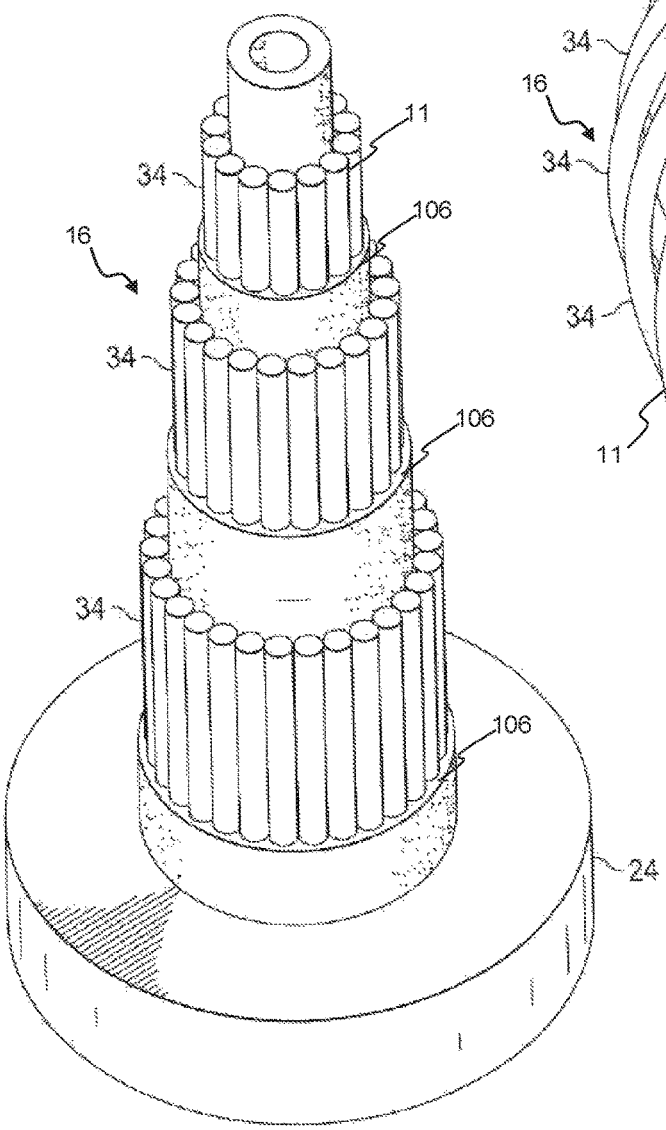
FIGS. 15 and 16 show embodiments helical and tiered artificial wicks, and include intertwined or braided light sources, or fiber optic cables of varying colors, or LED lights/tubes.
Figure 16:
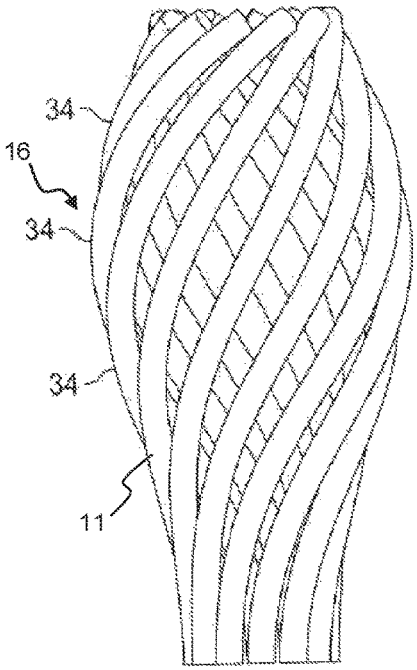

The resonator 24 has at least one centrally located transducer opening 32 configured to allow the aerosol 12 to rise through the transducer opening 32, and helps shape the aerosol vapor 12 such that is swirls, floats, or produces other selected shapes. At least one light source 34, which may produce a colored light or be a colored light source, is configured to illuminate the aerosol 12 to create the appearance of a flame. The light source 34 may be a light emitting diode (LED) source, integrated fiber optic light source, and is internal to the candle 10 such as shown in FIG. 15 and FIG. 16. Color filters 36 may be used as well. The light source 34 may also comprise a polymer optical filter that provides light to image the aerosol 12. The colors may vary from the blues, yellows, oranges, and red, thereby emulating the varying colors of a flame, and may be intermittent, flicker, travel, or change colors. The light source 34 may be configured to illuminate the mist from below, or the candle artificial wick 11 may provide the light source from within the mist, i.e. the candle artificial wick would be encapsulated within the mist. The candle artificial wick 11 may have different shapes i.e. helical, tiered, and include intertwined or braided fiber optic cables of varying colors that may travel along the cables, or LED lights/tubes.

Figure 3:
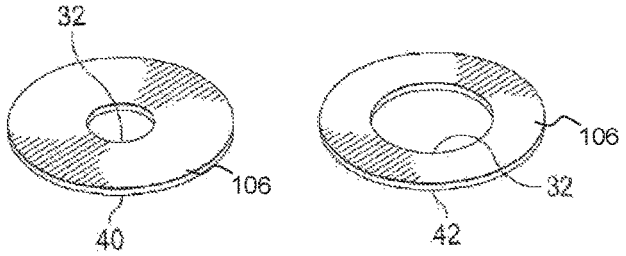
FIG. 3 illustrates alternative resonator designs having different transducer opening sizes.
Figure 4:
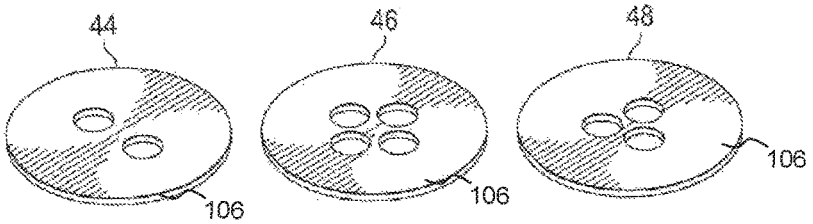
FIG. 4 illustrates alternative resonator designs having multiple transducer openings.

Referring to FIGS. 3 and 4, exemplary transducers 106 may consist of a certain shape, dimension, material type, impressions, perforations, notches, etc. resulting in shaping the liquid into mist/aerosol with flame-like characteristics. The transducer may be comprised of a metal plate, or a ceramic element/material of suitable composition, electrode patterns, such as solid, wrap-around, side-tab, insulation band, bull's-eye, tolerances such as, capacitance, d33 value, Frequency, voltage, shape, size, surface finish, shaping process and/or post-processing, specific patterns or alternative electrode materials including, but not limited to, nickel or gold. The resonator 24 may have larger and/or shaped transducer openings 32, such as shown as resonator 40 and resonator 42 in FIG. 3, or have a plurality of transducer openings 32 as shown with resonators 44, 46 and 48 in FIG. 4. The different transducer opening(s) designs provide varying dielectric resonator responses and resultant aero vapor shapes to produce a different actual flame-like appearance.

Figure 5:
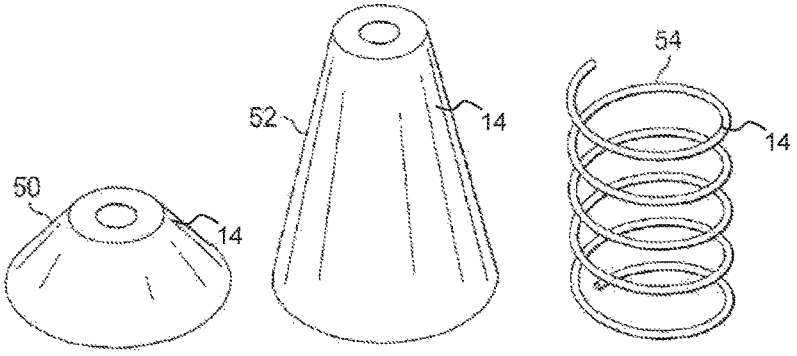
FIG. 5 illustrates alternative nozzle designs.

Referring to FIG. 5, the nozzle 14, or manifold, may have other shapes/sizes, such as shorter cone nozzle 50, or taller cone nozzle 52, or be configured as a spiral nozzle 54. The various nozzles 14 help shape the aerosol, and also control the height and variations in the height of the aerosol 12. The nozzle 14 can be created via fast 3-D printing techniques, enabling a variety of aerosol 12 shapes. A cone shaped nozzle may be preferred as it may shape the exiting mist to resemble a flame.

FIG. 6 shows an example drive signal 108 delivered to the transducer 106 to create and control variations in the mist plume 12. The drive signal 108 may be a digital signal or an analog signal. Variations in amplitude and frequency of the signal may create variations in the mist plume 12.

Figure 7C:
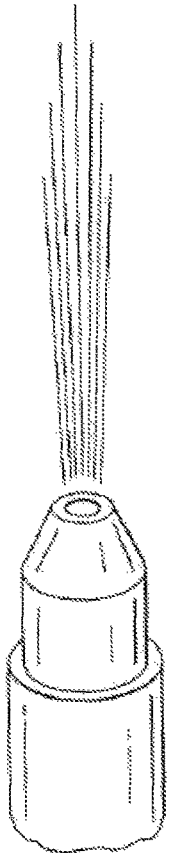
FIGS. 7A-7C illustrate different simulated flames that are generated by various embodiments of the disclosure.
Figure 7B:
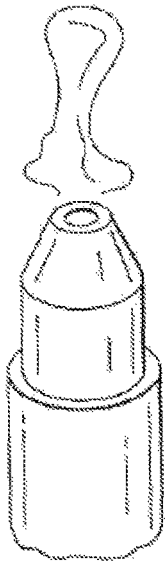
Figure 7A:
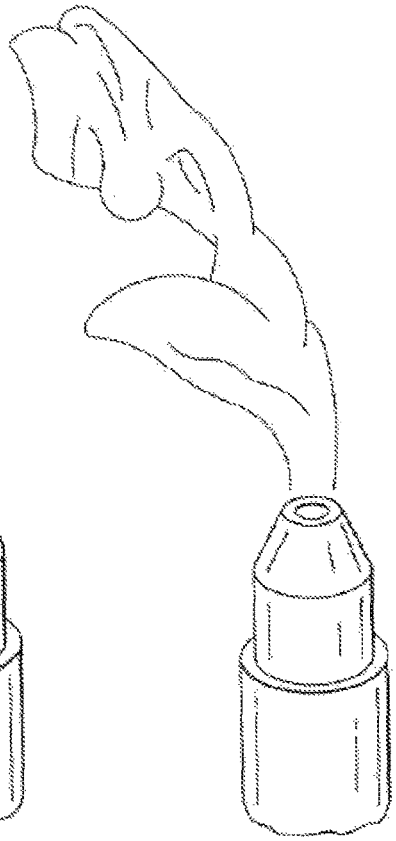

Various illuminated aerosol vapors that can be created are shown in FIG. 7A, FIG. 7B and FIG. 7C.

An alternative embodiment of this disclosure is shown in FIGS. 8-17. This embodiment creates a realistic multiuse, multiplatform flame technology. This embodiment includes fireplace units that are fully integrated and can be incorporated into any sized opening or manufacturer's firebox, along with any available log set on the market. This creates a realist looking, safe alternative to fire.

Figure 8:
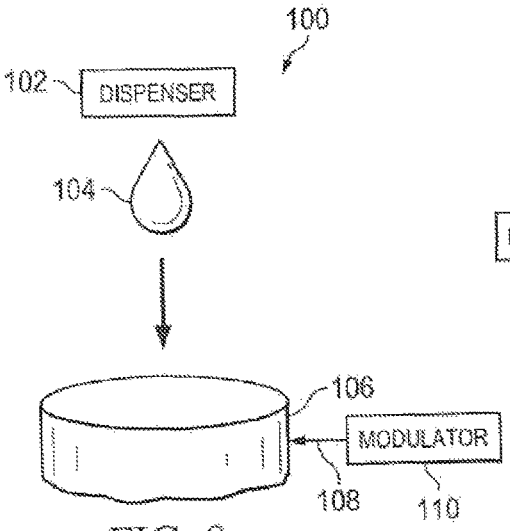
FIGS. 8-11 illustrate an apparatus and method of dispensing droplets of a fluid on a transducer to create a mist plume.

One illustrative embodiment shown in FIGS. 8-11 comprises an imitation flame generator 100 that includes realistic vapor flame technology (RVFT) utilizing variable evaporating droplet technology (VEDT). This generator 100 comprises a liquid dispenser 102 configured to dispense liquid droplets 104 onto a piezoelectric transducer 106, as shown in FIG. 8. The dispenser 102 can take many forms, and may include a fluid reservoir, or may receive fluid via a conduit feeding one or more openings. The transducer 106 is driven by a modulated resonating drive signal 108 generated by a modulator 110. The modulator 110 may be comprised of a Class E inverter and/or a piezoelectric transformer. The dispenser 102 may be comprised of devices and/or effects such as capillary effect, use of solenoid valves, a cavitation process tubes, pumps, wicking effect, and/or the implementation of fluidic technology such as switches, amplifiers, oscillators, and the like, that control the specific droplet size being dispensed onto the transducer.

Figure 9:
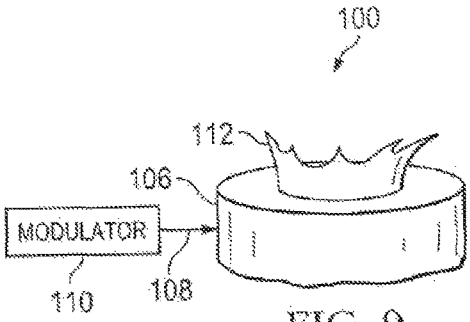

As shown in FIG. 9, the droplet 104 impinges upon transducer 106 to disperse, like a splash as shown at 112. The droplets 104 may be of different sizes and be intermittently disposed/placed on certain/key places on the transducer 106 by the dispenser. The mist changes shape and size as a function of the varying size/shape of the droplets being dispensed to the transducer.

Figure 10:
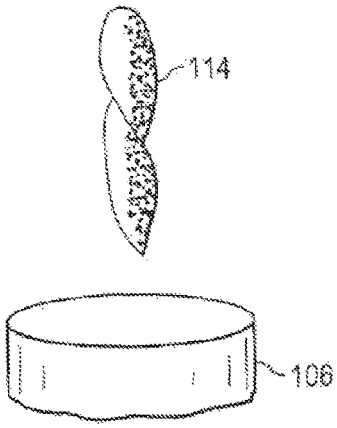
Figure 11:
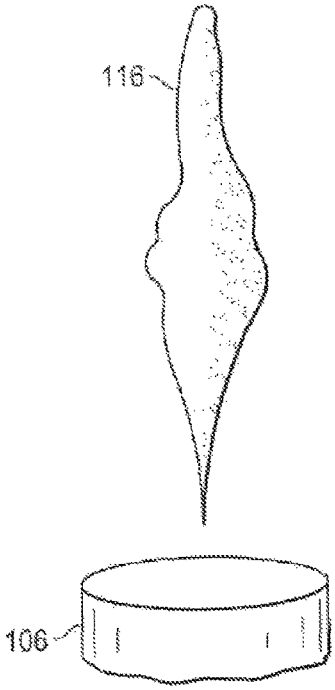

As shown in FIG. 10, the modulated transducer 106 causes the dispersed droplet 112 to transduce and form a mist/aerosol 114 that rises from the transducer 106. The varying energy of drive signal 108 delivered to the transducer 106 causes the mist 114 to transform into a vapor plume 116, as shown in FIG. 11. Varying energy of the drive signal 108, as shown in FIGS. 8 and 9, to the transducer 106 results in the liquid being atomized/nebulized at different mist/aerosol droplet sizes. The drive signal which may be generated by the modulator may produce a drive signal with irregular varying frequencies, irregular power, pulse width modulation ratios and the like. This variation in mist/aerosol droplet sizes results in varying heights, shapes/sizes of the plume 116. This modulation of energy to the transducer 106, varying liquid droplet sizes onto the transducer 106, and/or the resultant varying mist/aerosol droplet sizes cause the vapor plume 116 to move up and down, emulating the dancing effect of a real flame. This is the resultant of the vapor-resonator interface.

In one illustrative embodiment, the resonant frequency of the drive signal 108 of the modulated transducer 106 is a driving signal of 28.52 kHz, at an operating power about 20 Watts. In other embodiments the frequency may be about 100 kHz. The diameter of the transducer 106 is 26 mm (about 1 inch). What creates the flame effect is the generated irregular, ultrasonic wave that spreads upwards from the modulated transducer. This works brilliantly for candles. Essential oils can be added to the liquid and diffused for scented candles—opening a market of proprietary products.

The transducer 106 arrangements can be one of a number of types, such as a piezoelectric transducer creating a high frequency mechanical oscillation just below the surface of a source of water, such that an ultrasonic vibration turns the liquid into mist. The dispensed fluid, such as water, may be dispersed as onto the modulated transducer 106 to take advantage of gravity. The droplets may be a substantially consistent size or inconsistent size. The water may be injected onto the transducer 106 using an injector, and the water may be a standing liquid residing in a basin. The fluid can be transported, dropped, placed, pushed onto, through transducer 106 in many fashions. The implementation of capillary effect, use of solenoids, tubes, pumps, wicking effect, and/or the implementation of fluidic technology such as switches, amplifiers, oscillators, and the like, may be utilized to effectively transport liquid and/or create plume motion and support functions that may allow for the movement of specific sized droplets of liquid onto the transducer. Liquid may be injected, pumped, pressurized onto the transducer 106. A fluidic switch and/or a solenoid valve may be utilized to effectively create and move specific sized droplets of liquid for movement and release onto the transducer 106. A system of fluid supply channels through a solenoid valve, and/or a cavitation process, may provide random plume sizes as droplets are intermittently delivered onto the transducer to create various flame heights to mimic a real flame. Integrated circuitry may allow random frequency/power modulation of the transducer. Variable droplet size may be achieved through a fluidic valve delivery system or through a modulated pump system disseminating fluid onto the transducer in several fashions including, but not limited to, dropping via gravity, pushing or pumping, capillary effect, injecting and the like. The liquid may be brought into contact from below, the side, and/or the center onto the transducer.

Figure 12:
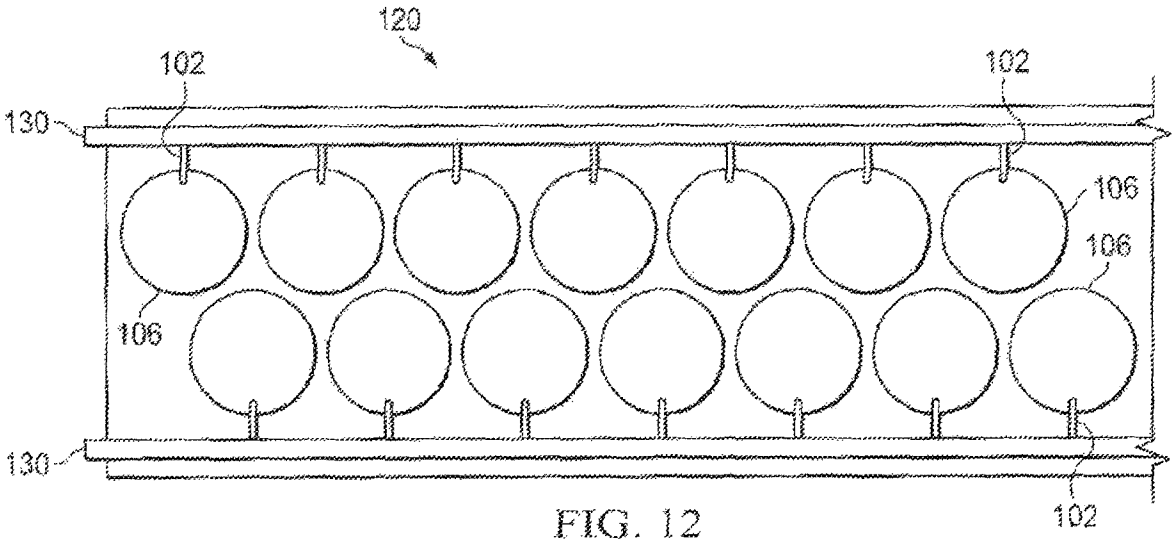
FIG. 12 illustrates an insert comprised of multiple embodiments.
Figure 13:
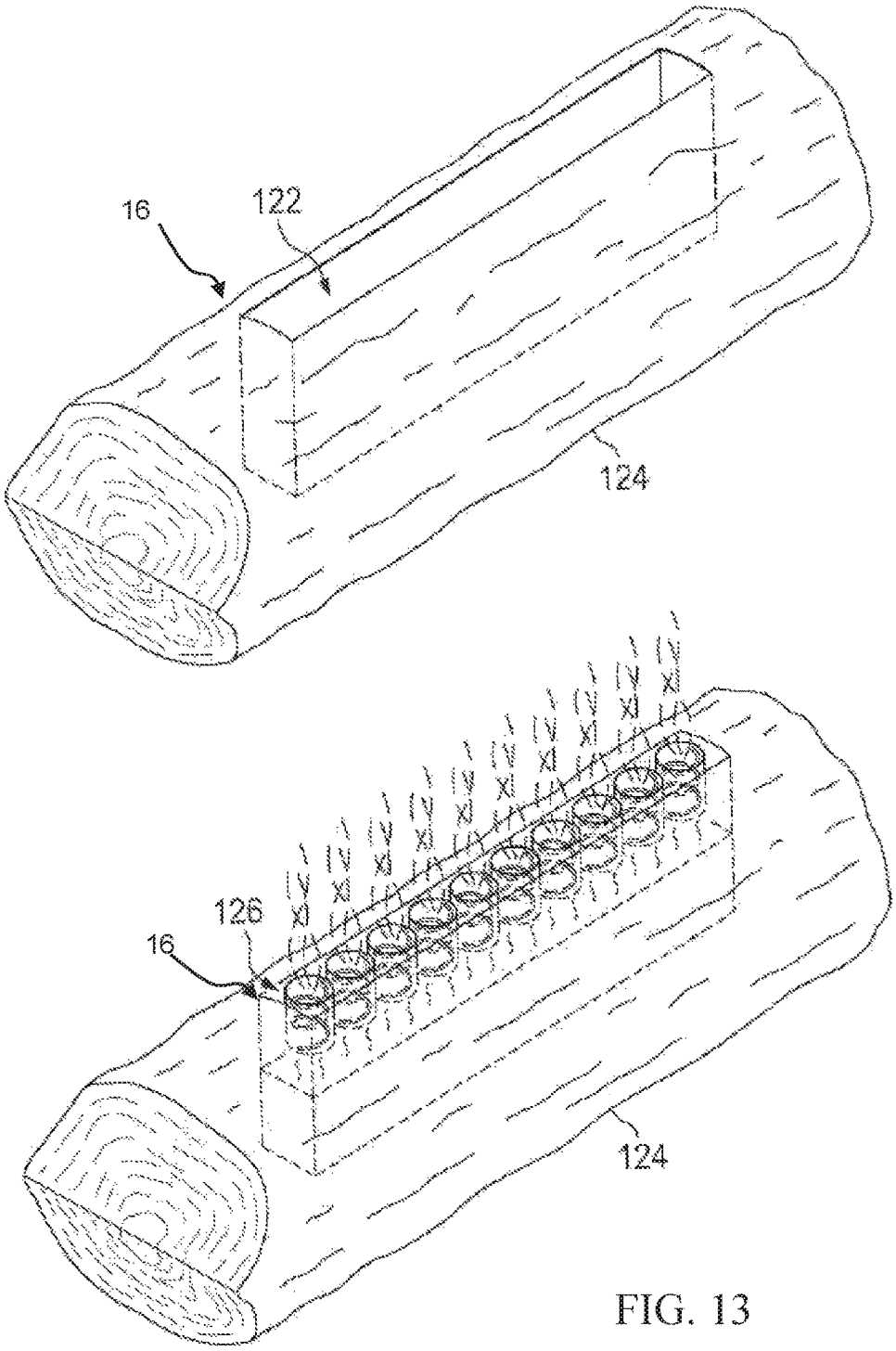
FIG. 13 illustrates an imitation log for receiving the insert.

One embodiment comprises a fireplace insert 120 as shown in FIG. 12, where several transducers 106 may be lined up in a varying tiered offset radius pattern, with random droplet sizes being dispensed onto the transducers 106 at different intervals, creating a realistic dancing vapor flame. The insert 120 may be positioned in a recess 122 of a carved log 124 such as shown in FIG. 13. An artificial fire log or artificial flame configured with a log or log shaped housing may comprise a Ruben's tube having a transducer that creates sound waves that vary the shape, size and/or height of the flame from the individual enclosure openings, as shown in FIGS. 1 and 3 of provisional patent application No. 62/554,419; incorporated by reference herein.

Figure 14:
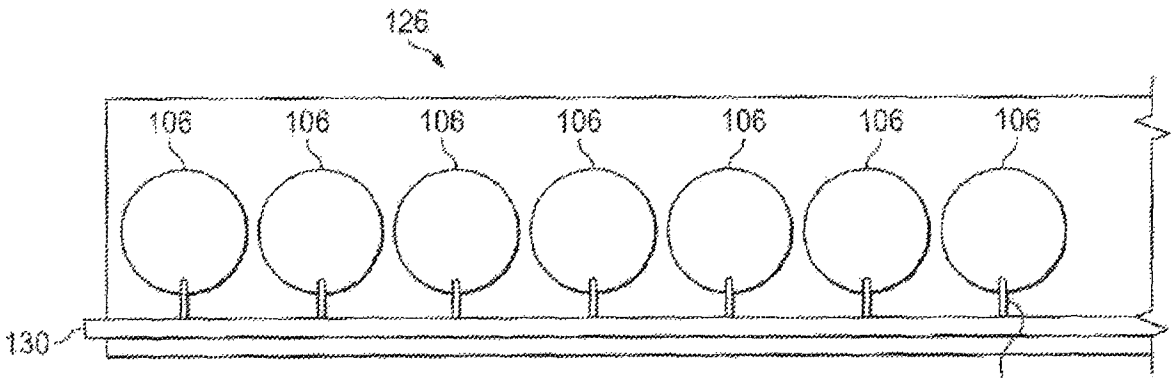
FIG. 14 illustrates another embodiment of an insert.

FIG. 14 shows an insert 126 having linearly arranged transducers 106. The dispensers 102 comprise nozzles fed by a conduit 130, which conduit 130 is fed by a liquid such as water from the fluid reservoir.

FIGS. 15 and 16 show embodiments of helical and tiered artificial wicks, and include intertwined or braided light sources, or fiber optic cables of varying colors, or LED lights/tubes. Light sources 34 may be arranged in a tiered configuration with a transducer 106 at each tier. The light sources 34 may be shaped to create an artificial wick 11 that may simulate the shape of a flame or a wick.

Figure 17:
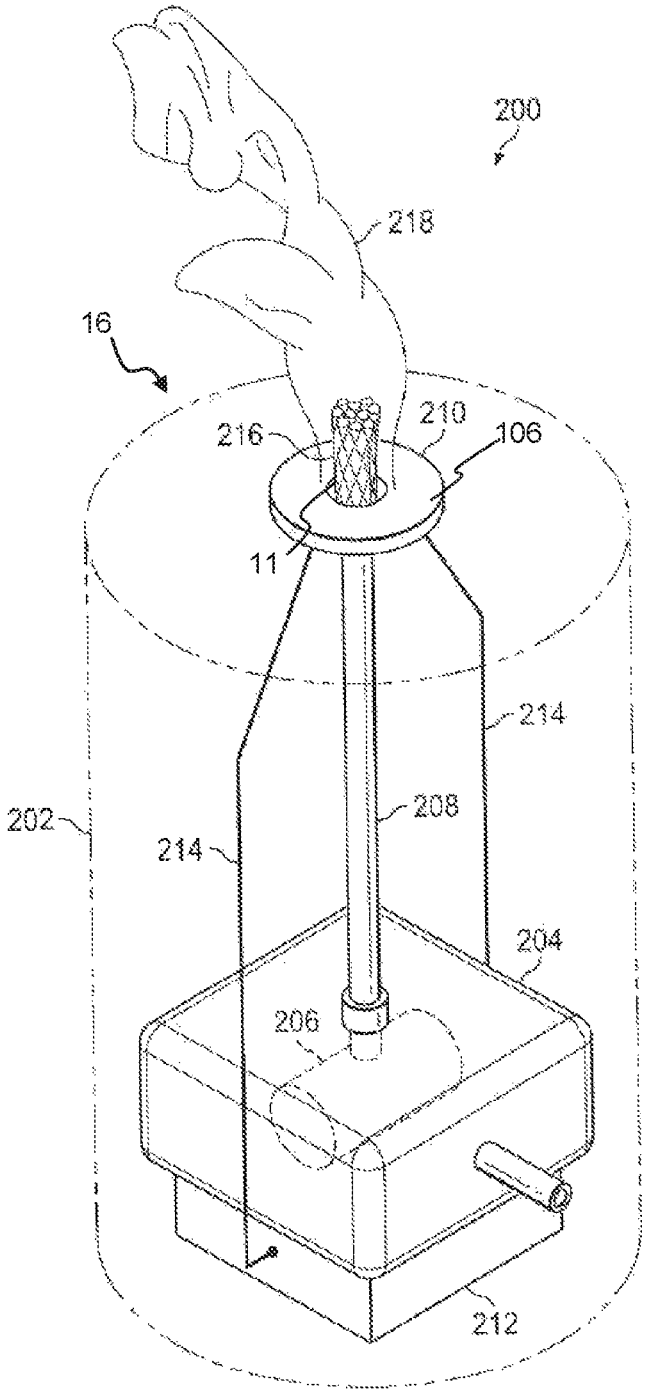
FIG. 17 shows another embodiment including a liquid reservoir and pump.

FIG. 17 shows another embodiment of a candle at 200, shown to include a body 202, liquid reservoir 204, pump motor 206, liquid delivery conduit 208, resonator 210, control circuit 212, electrical conductors 214 providing a modulated drive signal, artificial wick 216, and vapor plume 218. Similar to the previous embodiments, the pump 206 delivers liquid in constant or varying droplet sizes from reservoir 204 via vertically extending conduit 208 to proximate the resonator 210. The resonator 210 modulates the presented liquid to create the vapor plume 218, wherein varying the power and/or waveform of the modulated control signal generated by control circuit 212 causes the vapor plume 218 to shape. The pump motor 206 may deliver liquid in varying droplet sizes causing the vapor plume 118 to shape. On or more light sources, such as a LED fibers), can be disposed in or about the artificial wick 216 to color the vapor plume 218 and resemble a flame.

Figures 18, 19:
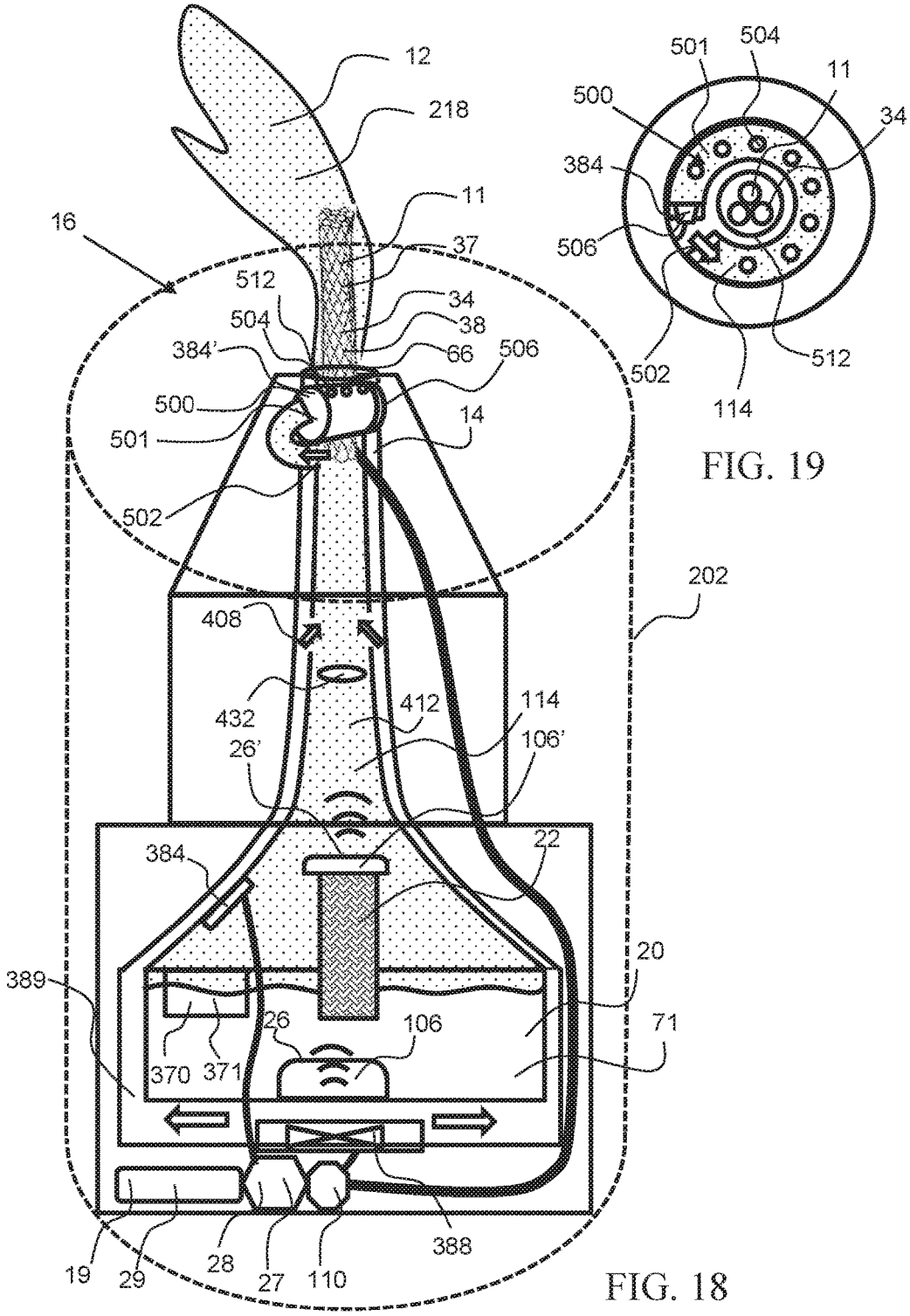
FIG. 18 shows a diagram of an exemplary artificial flame apparatus comprising a liquid reservoir, a transducer to produce a mist, an oscillator to vary the rate of flow of the mist from the housing and a plurality of light sources configured to illuminate said mist exiting the housing.
FIG. 19 shows an exemplary oscillator comprising a standing wave tube 500, also referred to as a Ruben's tube that is configured in a circular form around the artificial wick 11.

As shown in FIG. 18, an exemplary artificial flame apparatus 16 comprises a liquid reservoir 20, transducers 106 (106') to produce a mist 114 that collects in the mist reservoir 412. An oscillator 384 varies the rate of flow of the mist from the housing 202 such that the vapor plume 218 of mist changes shape or height. The oscillator 384, which may produce waves, pressure gradients and/or vibrations, may cause the flow of the mist to pulsate, swirl, etc., producing a dancing-flame effect to the resultant vapor plume. A light source 34 may be configured to illuminate the vapor plume 218 or vapor mist 12 exiting the housing around the artificial wick 11 and may also illuminate the artificial wick 11. The artificial wick 11 may comprise the light source 34 and may comprise a fiber optic 37 or light tube 38, for example. As described herein, the fiber optic or light tube may be configured to look like a wick or flame and/or a plurality of light sources, such as fiber optics or light tubes may be twisted about each other, such as spiral wrapped, tiered, helical, braided etc. The light emitted by the light source may be a colored light and may change color and/or intensity to produce a more realistic artificial flame. A portion of the fiber optic or light tube may be colored, and a portion may be translucent or transparent to allow the light to emit therefrom. The cover nozzle 14 may be of various shapes to channel and shape the vaporized mist generated from the resonator 106 as it exits the housing 202. A light source, such as a ring of light 66, may be configured proximal to the enclosure opening 504 or at the nozzle exit and this light source may produce a colored light such as white, blue, red, orange, yellow, etc., to reflect and illuminate the mist and vapor plume 218, and/or an artificial wick 11. The light emitted by the light source may be a colored light and may change color and/or intensity to produce a more realistic artificial flame. One or more light sources, such as fiber optic cables and/or filaments, LED fiber(s), can be disposed in or about the artificial wick 11 to color the vapor plume 218 to resemble a flame. The artificial wick, or a portion thereof, may also be colored to resemble a burnt candle wick. The wick may be helical, tiered, shaped, molded, and may include intertwined or braided light sources such as fiber optic cables of varying colors, or LED lights/tubes.

An air-moving device 388, such as a fan, may produce a flow of air, as indicated by the bold arrows that forces the mist 114 from the housing. Power to the fan may be modulated to control a flow of air to further shape and control the mist plume. As shown, the air-moving device produces a flow of air that travels through flow conduits 389 and then through inlets 408 into the mist reservoir 412 to force the mist 114 out of the housing 202. A splash guard 432 may be configured to prevent large droplets of liquid from entering and/or exiting the housing through the nozzle 14. The splash guard may prevent condensation droplets from dropping onto the transducer. The air-moving device may be controlled by a controller 27 having a control circuit 28 and a modulator 110 that changes air-moving device output, which may change the flow rate of the airflow and subsequently the rate of mist exiting the housing. A modulator may also regulate the transducers to vary the rate of mist production, as a function of a controller. A modulator may also control the light emitted by the light source by changing colors and/or intensity to produce a more realistic artificial flame. A shaping nozzle 512 may be configured to shape the mist as it exits the housing to form a flame shaped vapor plume 218.

As shown in FIG. 18, there are two representative transducers 106 and 106'. The first transducer 106', is located outside the liquid reservoir 20 and comes in contact with liquid 71 from the liquid reservoir via a porous wick structure 22 that draws liquid from the liquid reservoir via capillary forces to the transducer surface 26'. A second representative transducer 106 is located within the liquid reservoir 20. The transducer surface 26 of the transducer 106, or mist producing surface, is in direct contact with the liquid of the liquid reservoir. An exemplary artificial flame apparatus 16 may comprise one transducer or a plurality of transducers.

As shown in FIG. 18, a pod 370 is configured to retain an agent or plurality of agents, such as an aroma agent 371 that mixes with the liquid in the liquid reservoir to produce a mist having a fragrance or scent.

The vapor mist 12, or vapor plume 218 produced by the exemplary artificial flame apparatus 16 may be configured to oscillate or change shape, size or height to mimic a real flame that moves, dances, and changes shape. An oscillator 384 may create sound waves, vibrations, or pressure gradients that force the mist 114 from the housing 202 at a variable rate, thereby creating a changing plume. An oscillator may produce sound waves, sound pressure or acoustical pressure, and may be configured with a standing wave tube 500, also referred to as a Ruben's tube. An oscillator may be used to create waveforms controlling properties such as amplitude, frequency, rise time, time interval, distortion and others. Mist 114 may enter an inlet 502 to enclosure 501 of the standing wave tube and a sound wave generator 506 may create sound waves/sound pressure that travel along the enclosure 501 forcing the mist out of enclosure openings 504 in the enclosure 501. The mist may be expelled from the enclosure openings as a function of the sound wave, or sound pressure, whereby it may change at a rhythm or beat of the sound wave. The controller 27 and/or modulator 110 may control the sound generator 506 to produce a mist that moves to a particular beat or rhythm due to the controlled variation in the sound waves. This variation may be the product of an acoustical selection or creation, sound wave pattern creation, modulated sound wave pattern or may be random. The oscillator may be a surface acoustic device.

An exemplary artificial flame apparatus may comprise a power source 29, such as a battery or rechargeable battery 19 or a wired power connection, such as a plug adapted to be plugged into an electrical outlet including a wall outlet or a Universal Serial Bus (USB) outlet/micro USB or similar manner. In an exemplary embodiment, a rechargeable battery is configured within the housing 202 of the artificial flame apparatus and is configured to be recharged through a USB connection.

As shown in FIG. 19, an exemplary oscillator 384 is a standing wave tube 500, also referred to as a Ruben's tube that may be configured in a circular form, wherein the enclosure 501, such as a tube, extends in an arc around the artificial wick 11. The mist may enter the enclosure 501 through an inlet 502 and a sound generator, an oscillator 506, may produce sound waves and sound pressure that forces the mist 114 from the enclosure opening 504. As shown the enclosure extends around a portion of the artificial wick and the artificial wick comprises a light source 34. A shaping nozzle 512 may be configured to shape the mist as it exits the housing to form a flame shaped vapor plume 218.

Other uses of the apparatus as described herein, may include biological applications, not necessarily related to simulation of a realistic flame, pyrotechnics, fire pits, torches, car exhaust tubes, education, magic acts, special effects, military/law enforcement/first responders training, etc. This flame technology can be utilized in any application requiring the simulation/replication of a realistic flame. The appended claims set forth novel and inventive aspects of the subject matter described above, but the claims may also encompass additional subject matter not specifically recited in detail. For example, certain features, elements, or aspects may be omitted from the claims if not necessary to distinguish the novel and inventive features from what is already known to a person having ordinary skill in the art. Features, elements, and aspects described herein may also be combined or replaced by alternative features serving the same, equivalent, or similar purpose without departing from the scope of the invention defined by the appended claims.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An artificial flame apparatus comprising:

a) a housing;

b) a liquid reservoir within said housing and containing a liquid;

c) an artificial wick extending from said housing;

d) a transducer having a transducer surface;

wherein said liquid from the liquid reservoir contacts the transducer surface to produce a mist;

e) a controller configured to generate a modulation signal, wherein the modulation signal is configured to drive the transducer to create said mist from said liquid in contact with the transducer surface;

f) a housing opening in the housing that is proximal to the artificial wick; wherein said mist exits the housing through said housing opening and around said artificial wick;

g) a light source configured to illuminate said mist exiting the housing;

wherein the illuminated mist appears as an artificial flame; and h) a shaping nozzle configured to shape the mist as it exits the housing.

2. The artificial flame apparatus of claim 1, wherein the artificial wick comprises said light source.

3. The artificial flame apparatus of claim 2, wherein the artificial wick comprises a fiber optic light source.

4. The artificial flame apparatus of claim 2, wherein the artificial wick comprises a plurality of fiber optic light sources.

5. The artificial flame apparatus of claim 4, wherein the plurality of fiber optic light sources are twisted about each other.

6. The artificial flame apparatus of claim 2, wherein the light source is a light tube.

7. The artificial flame apparatus of claim 1, comprising a plurality of light sources wherein the controller controls at least a portion of said plurality of light sources to produce a colored light that varies in intensity.

8. The artificial flame apparatus of claim 7, wherein the controller controls a first light source to produce first colored light, and wherein the controller controls a second light source to produce a second colored light, and wherein the first colored light and the second colored light are different colors.

9. The artificial flame apparatus of claim 1, wherein the transducer is at least partially submerged in the liquid reservoir.

10. The artificial flame apparatus of claim 1, wherein the transducer is an ultrasonic resonator.

11. The artificial flame apparatus of claim 1, wherein the transducer comprises a piezoelectric device.

12. The artificial flame apparatus of claim 1, wherein the transducer comprises a surface acoustic device.

13. The artificial flame apparatus of claim 1, further comprising a wick structure configured between the liquid reservoir and the transducer surface; wherein said wick structure wicks liquid from the liquid reservoir to the transducer surface.

14. The artificial flame apparatus of claim 1, wherein the transducer has at least one transducer opening configured to pass the mist.

15. The artificial flame apparatus of claim 1, wherein the modulation signal comprises different waveforms such that the mist exiting the housing has a varying shape, size, and/or height.

16. The artificial flame apparatus of claim 1, wherein the modulation signal comprises varying power levels such that the mist has a varying shape, size and/or height as a function of the varying power levels.

17. An artificial flame apparatus comprising:

a) a housing;

b) a liquid reservoir within said housing and containing a liquid;

c) an artificial wick extending from said housing;

d) a transducer having a transducer surface;

wherein said liquid from the liquid reservoir contacts the transducer surface to produce a mist;

e) a controller configured to generate a modulation signal, wherein the modulation signal is configured to drive the transducer to create said mist from said liquid in contact with the transducer surface;

f) a housing opening in the housing that is proximal to the artificial wick; wherein said mist exits the housing through said housing opening and around said artificial wick;

q) a light source configured to illuminate said mist exiting the housing;

wherein the illuminated mist appears as an artificial flame; and h) an oscillator device that varies a flow of mist from the housing opening such that the mist exiting the housing has a varying shape, size, and/or height.

18. The artificial flame apparatus of claim 17, wherein the oscillator device produces sound waves and resulting sound pressure that varies the flow of mist from the housing opening.

19. The artificial flame apparatus of claim 17, wherein the oscillator device comprises air-moving device that varies the flow of mist from the housing opening.

20. The artificial flame apparatus of claim 17, wherein the oscillator comprises a standing wave tube comprising:

a) an enclosure for receiving the mist;

wherein the enclosure has one or more enclosure openings for the mist exiting the enclosure;

b) a sound-wave generator that emits sound waves having a sound wave frequency into the enclosure and produces sound pressure;

wherein the sound pressure forces the mist from the one or more enclosure openings as a function of the sound wave frequency.

21. The artificial flame apparatus of claim 20, wherein the enclosure extends around a portion of the artificial wick.

22. An artificial flame apparatus, comprising:

a) a housing;

b) a liquid reservoir within said housing and containing a liquid;

c) an artificial wick extending from said housing;

d) a transducer having a transducer surface;

e) a wick structure configured between the liquid reservoir and the transducer surface; wherein said wick structure wicks liquid from the liquid reservoir to the transducer surface; and wherein the transducer creates mist from said liquid wicked to the transducer surface and wherein said mist creates a vapor plume as it exits the housing;

f) a first light source configured with the artificial wick to illuminate said mist exiting the housing;

g) a second light source coupled to the housing to illuminate said mist exiting the housing;

h) an oscillator device comprising a sonic device that produces sound waves that pushes the mist from the housing such that the mist exiting the housing opening has a varying shape, size, and/or height;

i) a controller configured to generate a modulation signal, wherein the modulation signal is configured to drive the transducer to create and vary said mist created by the transducer surface; such that the vapor plume changes shape as a function of the modulation signal;

wherein the controller varies the first light source configured with the artificial wick to change color and intensity;

wherein the controller varies the second light source coupled to the housing to change color and intensity; and wherein the controller controls the oscillator device that produces the sound waves;

j) a mist reservoir within the housing that receives said mist generated by the transducer;

k) a housing opening in the housing that is proximal to the artificial wick; wherein said mist from the mist reservoir exits the housing through said housing opening and around said artificial wick;

wherein said illuminated mist appears as an artificial flame; and l) a shaping nozzle that shapes the mist as it exits the housing.

23. An artificial flame apparatus comprising:

a) a housing;

b) a liquid reservoir within said housing and containing a liquid;

c) a transducer having a transducer surface;

wherein said liquid from the liquid reservoir contacts the transducer surface to produce a mist;

d) a controller configured to generate a drive signal, wherein the drive signal is configured to drive the transducer to create said mist from said liquid in contact with the transducer surface;

e) a shaping nozzle configured to pass and shape the mist through a housing opening in the housing; wherein said mist exits the housing through said housing opening; and f) a light source configured to illuminate said mist.

* * * * *